US007476789B1

(12) United States Patent
Federici

(10) Patent No.: US 7,476,789 B1
(45) Date of Patent: Jan. 13, 2009

(54) CUSTOM MOLDED VIOLIN CHINREST

(76) Inventor: Nicole Suzanne Federici, 354 State St., Apt. 4B, Brooklyn, NY (US) 11217

( * ) Notice: Subject to any disclaimer, the term of this patent is extended or adjusted under 35 U.S.C. 154(b) by 87 days.

(21) Appl. No.: 11/325,949

(22) Filed: Jan. 5, 2006

(51) Int. Cl.
*G10D 3/18* (2006.01)
*G10D 1/02* (2006.01)

(52) U.S. Cl. ..... 84/279; 84/270

(58) Field of Classification Search ..... 84/270, 84/279

See application file for complete search history.

(56) References Cited

U.S. PATENT DOCUMENTS

| | | | | | |
|---|---|---|---|---|---|
| 439,199 | A * | 10/1890 | Schuster | 84/279 |
| 613,513 | A * | 11/1898 | Hoffman | 84/279 |
| 849,961 | A * | 4/1907 | Becker | 84/279 |
| 920,144 | A * | 5/1909 | Hughes | 84/279 |
| 931,251 | A * | 8/1909 | Beisheim | 84/279 |
| 1,023,234 | A * | 4/1912 | Williams | 84/279 |
| 1,387,216 | A * | 8/1921 | Wallace | 84/279 |
| 1,435,280 | A * | 11/1922 | Colbentson | 84/279 |
| 1,473,672 | A * | 11/1923 | Dittmann | 84/279 |
| 1,760,593 | A * | 5/1930 | Gosparlin | 84/278 |
| 1,821,811 | A * | 9/1931 | Kurt | 84/279 |
| 3,897,376 | A * | 7/1975 | Lampe | 524/863 |
| 4,587,288 | A * | 5/1986 | Maxson et al. | 524/425 |
| 4,719,835 | A * | 1/1988 | Biasini et al. | 84/279 |
| 6,239,337 | B1 * | 5/2001 | Stein | 84/279 |
| 6,278,044 | B1 * | 8/2001 | Ruan | 84/279 |
| 6,667,430 | B1 * | 12/2003 | Liao | 84/279 |
| 2007/0175309 | A1 * | 8/2007 | Buttemer | 84/279 |

* cited by examiner

*Primary Examiner*—Walter Benson
*Assistant Examiner*—Robert W Horn
(74) *Attorney, Agent, or Firm*—Klaus P. Stoffel; Wolff & Samson PC

(57) ABSTRACT

A device and method is disclosed for creating a customized chinrest for a violin or a viola, molded to conform to the precise idiosyncrasies of a player's chin and jaw, rendering greater comfort, support, range of motion, and control to the player. The chinrest of this invention is comprised of a rigid, flat, edgeless base upon which a removable, firm, but flexible silicone, custom molded top is adhered. The method of impression taking records complex contours, angles, and a range of motion created by head pivot of the player's chin and jaw while in the act of playing.

13 Claims, 4 Drawing Sheets

CUSTOM MOLDED VIOLIN CHINREST

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates generally to a chinrest for a violin or the like, and more specifically to a device and method for creating a customized chinrest molded to conform to the precise idiosyncrasies of a player's chin and jaw, rendering greater comfort, support, range of motion, and control to the player.

2. Prior Art

Violins are supported at three points on the player's body: the collarbone or shoulder, the jaw, and the hand which extends to support violin's neck. The bulk of the instrument's weight is supported upon the shoulder of the player. This point of support is further ensured by the jaw or chin's opposing hold on the top edge of the base of the instrument. A violinist transfers the support responsibility between these three points of contact. In transferring support in this way, each violinist employs her own unique combination of weight shifting, head pivoting, and instrument angling techniques. Each player's approach to her violin hold therefore demands unique and specific needs from the shoulder and jaw supporting points. To engage these body parts, a player drops her head weight into the small area of her jaw which contacts the violin chinrest, and thus presses the instrument into her shoulder. This action frees the fingering hand of much tension and responsibility in terms of support, and should serve to raise the instrument. Ideally, a player hopes to avoid raising their shoulder or clenching their neck muscles to complete the hold. Moreover, it is often necessary for the player to assume this chin or jaw engaged position for long periods of time during both practice and performance, so that optimum fit, comfort, and performance of the chinrest become essential.

Conventional chinrests are not custom contoured to each player's jaw, and therefore are not ideal violin manipulation tools. A conventional chinrest is either formed of wood or plastic, and is designed to fit a standard violin or viola. It is preferably carved or molded into a shape having a concave chin cup 18, FIG. 2, of sufficient size and an indentation general enough to accommodate varying sizes and contours of the chins and jaws of players. For example, some chins are jutting and have sharp lines, while others are rounder. Further, some chins are bonier than others which are covered with more fleshy tissue. Thus, for obvious reasons, the prior art chinrest may be a source of considerable discomfort to the performer. In fact, many beginning violinists do not progress beyond the early stages of violin instruction due to the discomfort suffered in their chins and jaws as a result of ill fitting or otherwise uncomfortable chinrests. Furthermore, the chin is used to control the violin's angle and position. For that reason, a properly shaped chinrest is important in the control of the instrument. Violinists whose chinrests are ill fitting commonly develop cysts at the chinrest abrasion site, or where the jaw contacts the support edge 20, FIG. 2, along with other overuse syndromes cased by the muscle tension created by the conventional chinrest. An ill fitting chinrest can also result in faulty left wrist and finger placement if proper control over the instrument can not be achieved. In addition, the surface of the conventional chinrest is hard and therefore not optimally comfortable against skin and bone. Many players have an allergy to some types of metal used in the clamp 16, FIG. 2 of the conventional chinrest.

One conventional and inexpensive solution to the problem of an uncomfortable and ill-fitting chinrest is to place padded overlays on the chinrest. These padded overlays are the only solution to discomfort associated with an ill fitting chinrest which has exhibited commercial success, because they are affordable, and therefore, easily forgiven if not totally effective. One popular product on the market is called the GelRest (Mill Valley, Calif.). It is a rubber overlay which is cut to fit the circumferential shape of the chinrest cup of most conventional chinrests. A player adheres that overlay to the surface of her conventional chinrest's cup, thus rendering the cup more comfortable to the skin and hard tissue of the jaw. These padded overlays provide limited and minimal improvement of a player's jaw and chin comfort by softening sharp edges which jut into the bone and soft tissue of the player's jaw; however, since the padded overlay can do nothing to change the inherent contours of the traditional chinrest, this method is not a successful solution to the problem of inaccurate fit of jaw contour and range of motion of a player. In addition, if overlays provided enough padding to entirely eliminate or recontour a sharp support edge 18, FIG. 2, in doing so, said overlays would also eliminate the support which that structural curvature is intended to provide, thus rendering the conventional chinrest useless as a support device.

Another solution to both the problem of an ill fitting, inflexible chin cup curvature and also the problem of accommodating a player's range of changing head rotation while playing is found in U.S. Pat. No. 4,534,259. In this patent, a chinrest design was disclosed having support brackets which allow the chinrest to pivot to a most comfortable position in accordance with the movements of the head of the performer. This chinrest also allows for some flexibility in the chinrest cup, in that the cup is constructed of a material with give or an elastically deformable cushion which covers an open centered circumference of a harder supporting material. Since this circumferential material is not contoured to fit the jaw of each player, some players find it uncomfortable, or even painful.

A further problem with U.S. Pat. No. 4,534,259 is the swiveling action, designed to accommodate a range of head motion. Such swiveling action, however, creates instability and a resulting lack of control over the instrument.

U.S. Pat. No. 4,719,835 describes an insert for a conventional chinrest for a violin or viola with a contoured shape which is molded to the shape of each performer's chin and jaw. Although there is no record of this invention's production or commercial sale; to date, this invention provides the best possible fit between a conventional chinrest and a player's chin and jaw. A possible reason for this invention's lack of commercial success was its ultimate inability to accurately fit the player's jaw and chin. Although this invention requires that the player use the flattest chinrest available as the base, there are no flat chinrests in manufacture. All conventional chinrests are concave. If the volume of thermoplastic was great enough to eliminate all curvature of the impression tray the player would end up making a chinrest that would be too high. Flat surfaced violin chinrests would offer no support or grab to the hold of a player. As a result of this, U.S. Pat. No. 4,719,835 only provides a partial solution to the problem of fit, support and comfort of the player. Although this invention improved the fit between the player's chin and jaw and chinrest, the insert failed to partner adequately with the conventional chinrest base. As a result, it was unable to take an accurate impression of the chin and jaw of a player while playing. In addition, this invention and method instructed the player to take one impression of her jaw in playing position. Since a player exhibits a range of jaw pivot while playing, the impression taking method of U.S. Pat. No. 4,719,835 was not sufficient to allow for the range of motion of a player's chin and jaw while playing, and created a restrictive, and therefore uncomfortable final product. Another problem remains unsolved by this invention: hard surfaces with curvatures are not the preferred interface to hard bone beneath human skin. When the chin and jaw of a player is shifting weight and position frequently, the plastic or hard surface offers no cushion to comfort the hardness of jaw and chin. A lack of flexibility in the chinrest creates discomfort of the chin and jaw. This discomfort inhibits precision and endurance both of which are essential to violin playing.

France Pat. No. FR2635218 (A1) describes a device and method of production of a violin chinrest contoured to the chin and jaw of an individual player, which also uses thermoplastic as its impression taking material. Along with the aforementioned lack of comfort provided by the resulting hard surfaced chinrest, this invention involves several steps in its production, and requires expertise in the art of mold making on the part of the manufacturer. As a result, this device and method especially relating to the creating of its base, is time consuming, and too involved for regular fabrication by the average violin player. Furthermore, aligning the constituent parts of this invention requires skill, adequate tools, and time, in order to produce an accurate final chinrest product. Laminating these three parts together will create a finished chinrest that in that state will have to be refined in some way to meet the standards of comfort, elegance and beauty within the art of violin playing. A technician would either have to sand off all edges to make them appear flush and smooth and then polish the finished chinrest, or either follow the suggestion of France Pat. No. FR2635218 (A1) and cover them with leather to create a more comfortable and polished looking final chinrest product.

Also, a player must fully assemble, glue and finish this chinrest before it can be tried in practice or performance. If the final chinrest is found to be slightly off, a technician must redo the entire process from the beginning, which would involve a total of five steps, and within those five steps there is a higher likelihood that one or more of them will be performed slightly off, resulting once again in an ill-fitting rest that will have to be reconstructed from the beginning.

OBJECTS AND ADVANTAGES

Accordingly, besides the objects and advantages of the custom molded chinrest described in my above patent, several objects and advantages of the present invention are:

(a) to provide a chinrest fabrication system and kit of materials that will create a complete custom molded chinrest;

(b) to provide a complete custom molded chinrest that will enable a player to comfortably hold a violin for long periods of time as in performing or practicing;

(c) to provide a device and method for fabricating a complete custom molded chinrest which any violin player can produce without prior expertise in the art of mold making;

(d) to provide a custom molded chinrest which will provide a violin or viola player with improved and precise control in order to correct faulty left wrist and finger position and faulty left shoulder position, and to avoid neck and back muscle strain;

e) to provide a device and method for creating a customized chinrest that conforms to the exact and precise contours and idiosyncrasies of a player's jaw and chin while they are in the position of playing;

f) to provide a device and method for creating a customized chinrest that is comprised of materials which are simple to manipulate;

g) to provide a device and method for creating a customized chinrest which allows for varying heights, curves, angles, and ranges of motion that a player might employ while in the act of playing, while, at the same time, avoiding any edges that could jut into the chin or jaw of a player;

h) to provide a device and method for creating a customized chinrest which offers the ease of a minor adjustment of the final rest or the ease of redoing the impression taking process if the player is not fully pleased with a particular, final mold;

i) to provide a device and method for creating a customized chinrest that will have a firm but flexible support shape;

j) to provide a device and method for creating a customized chinrest which results in an organically contoured product that measures up to the standard of elegance of the violin making and performing industries?

k) to provide a device and method for creating a customized chinrest that will allow for an optional volume of protective material in order to cover and protect the instrument rib and tailpiece from wear, and also to protect the violinist from any allergic reaction to the metals of the chinrest clamps;

l) to provide a device and method for creating a customized chinrest which will allow for customized durometers of support as well as surface texture;

m) to provide a device and method for making a customized chinrest that can be shaped, cured, and affixed into its final form in a short period of time;

n) to provide a device and method for making a customized chinrest that can be produced easily with a high level of accuracy the first time;

o) to provide a device and method for making a customized chinrest made up of parts which are designed to be used together and therefore, create an impression taking base of the most precise available accuracy;

p) to provide a device and method for producing a custom molded chinrest with a single base which can be used with multiple molded tops;

q) to provide a device and method for creating a custom molded chinrest which provides an optional finishing step for custom surface texture of the top portion of the chinrest; and r) To provide a device and method for creating a customized chinrest which can be molded in a wide variety of colors.

Still, further objects and advantages will become apparent from a consideration of the ensuing description and drawings.

SUMMARY

The present invention comprises a device and method for creating a complete chinrest for a violin or viola or the like, which is contoured to the shape, size, and range of motion of the player's chin and jaw bones. The present invention comprises four components:

1) The impression taking putty top, formed of a volume of malleable, rubbery material, which may be cured or hardened to retain its desired shape.

2) An interfacing layer made up of hook-and-loop fastener strips, which serves both to adhere the top and base components to one another for secure mold making and playing and to allow an optional separation of the top and base components as may be needed for fine rotational adjustments of the top component post molding, or for creating interchangeable top components to be used with the same base component.

3) An invented base portion comprised of a hard material such as polyurethane resin, which has been designed with a flat top surface and edgeless side expressly dedicated to receive the combination top and interface component, and to thus to optimize the accuracy of the impression made into that impression taking putty top component. The invented base portion also serves as the attachment means whereby the chinrest is clamped to the violin or viola or the like.

4) The final, optional component is the surface finishing technique and material which will either leave the surface of the molded top component untouched, or be dispensed over the top surface of the top, molded component, whereby the player can custom create a surface texture, color, and surface durometer, and thereby add to the overall surface comfort of the chinrest, and thus the overall comfort of the finished piece.

DRAWINGS

Figures

DRAWINGS

Reference Numerals

| | |
|---|---|
| 10 | standard violin chinrest, prior art |
| 12 | tailpiece |
| 14 | violin body |
| 16 | screw clamp |
| 18 | concave chin cup, prior art |
| 20 | support edge, prior art |
| 24 | base: edgeless side |
| 26 | screw clamp insertion hole |
| 28 | undercut space for tailpiece placement |
| 30 | foot of chinrest |
| 32 | base: flat top surface |
| 34 | strip of hook-and-loop fastener |

-continued

| | |
|---|---|
| 36 | impression taking putty |
| 38 | custom molded support edge |
| 40 | impression area |

DETAILED DESCRIPTION

FIGS. 1-7—Preferred Embodiment

Figure 1:
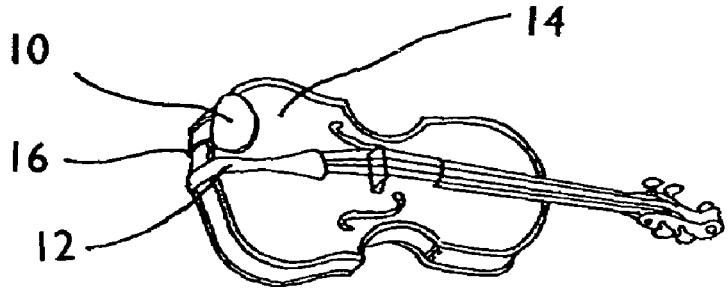
Fig. 1 Prior Art
FIG. 1 illustrates a top perspective view of a violin with a standard chinrest (prior art).
Figure 2:
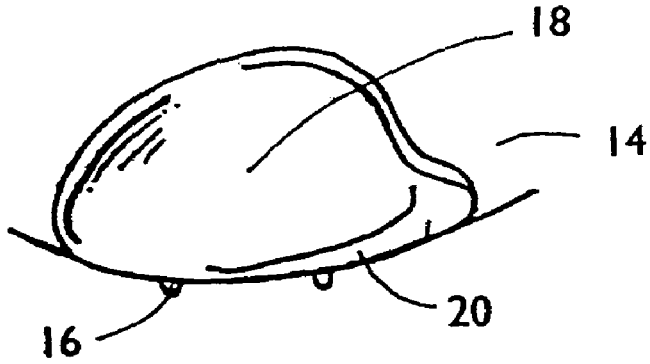
Fig. 2 Prior Art
FIG. 2 illustrates an enlarged top perspective view of the chinrest shown in FIG. 1 (prior art).
Figure 7:
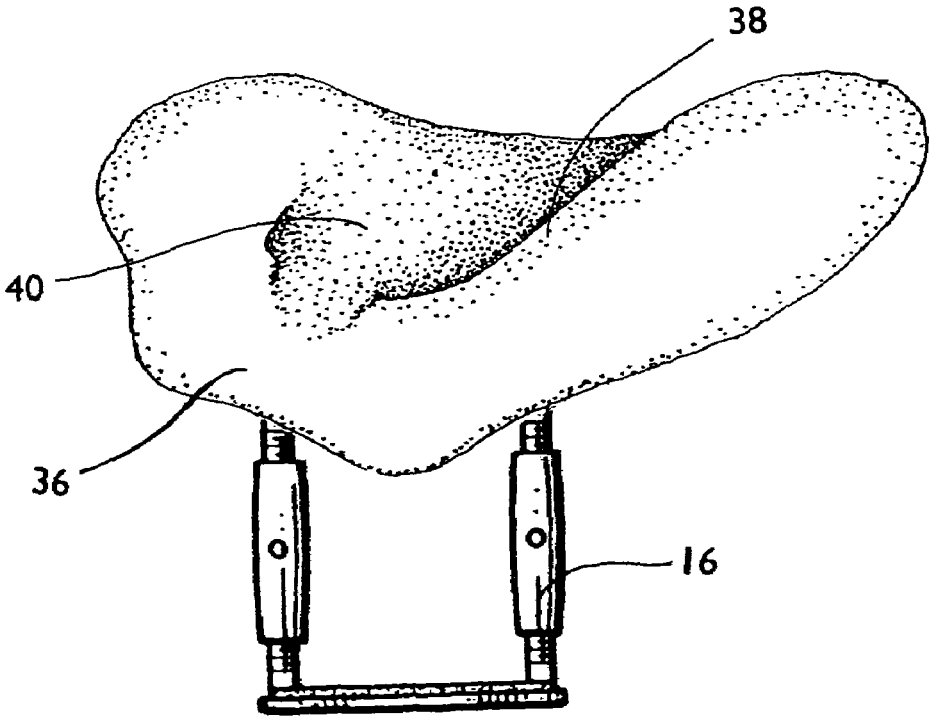
FIG. 7 illustrates a front perspective view of the preferred embodiment of the chinrest.

The preferred embodiment of the present invention provides a chinrest for a violin or a viola as shown in FIG. 7 with a contoured shape that is form fitting to a player's chin and jaw, and more specifically one that creates a support edge 38 that is custom molded to fit the contours and range of motion of that same player's jaw and chin. FIG. 2 is an enlarged view of a standard chinrest. As shown in FIG. 2 the standard chinrest comprises a concave chin cup 18 with a support edge 20 on the clamping side, with which the player controls the instrument using downward pressure which is secured by hooking her jaw over that support edge 20. Standard chinrests as shown in FIG. 2 are generally made out of wood or plastic and are fastened to the edge of a violin or viola body 14 near to the tailpiece 12, and using the aforementioned clamp 16.

Of course, it will be generally appreciated by a person of ordinary skill in the art that the present invention is easily produced by any violinist or violist, and is adaptable to a violin or viola at any place on the violin or viola where the chinrest FIG. 7 can be safely clamped or otherwise secured to the instrument, and where a player might choose to support her instrument. This includes holds over the tailpiece 12 and to the left side of the tailpiece 12.

Figure 3:
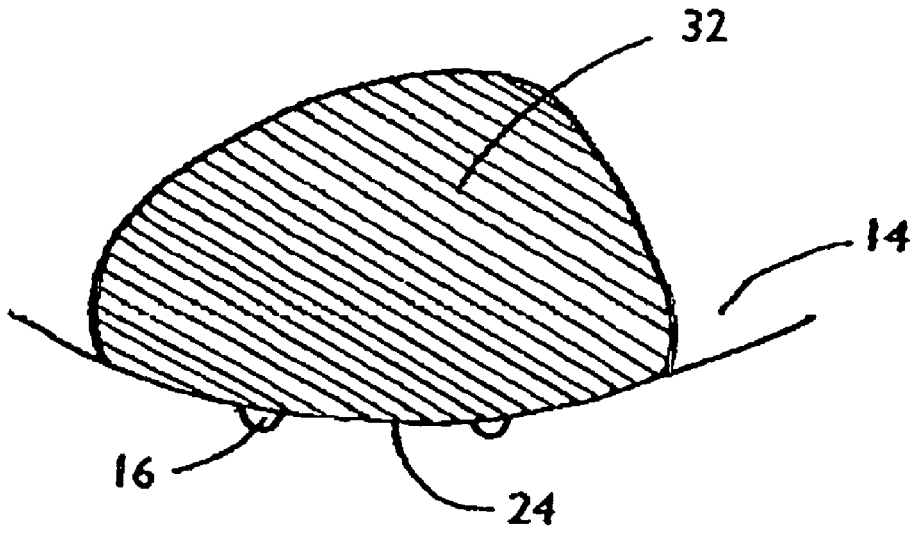
FIG. 3 illustrates a top side view of the invented chinrest base alone detailing the flat top surface.
Figure 3A:
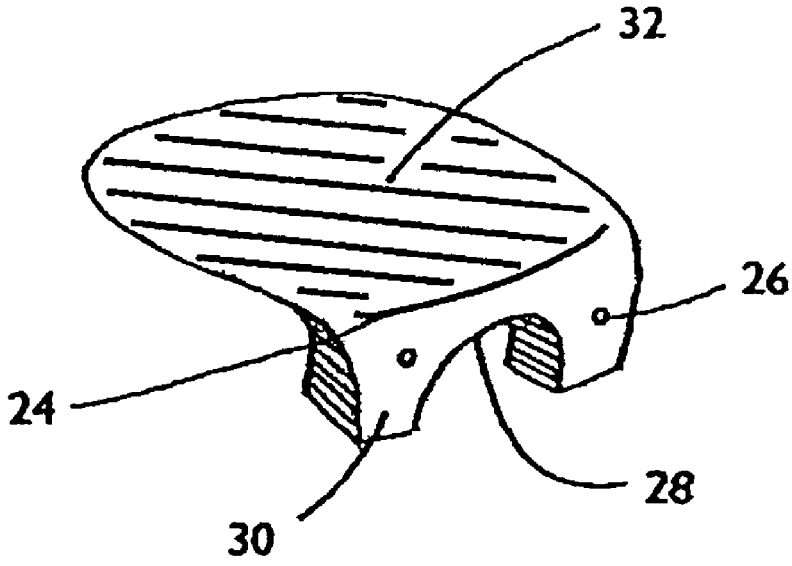
FIG. 3A illustrates a front perspective view of the invented chinrest base alone, detailing its flat top and edgeless side.
Figure 4:
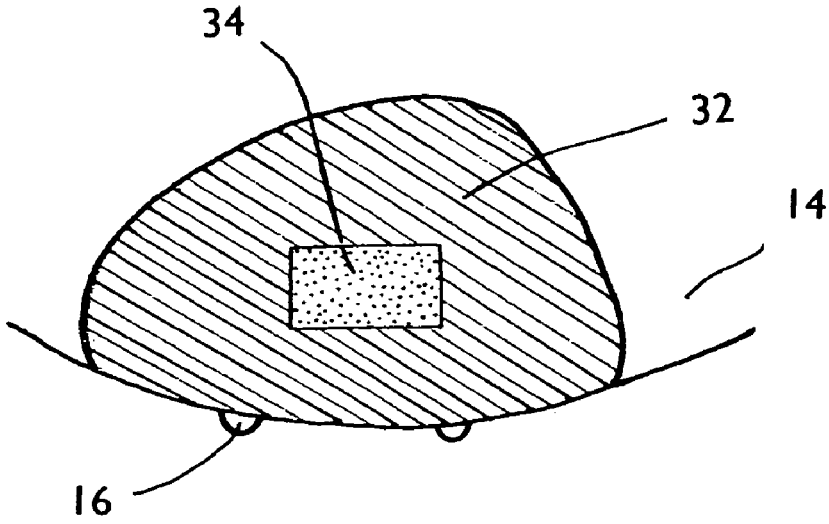
FIG. 4 illustrates a top side view of the invented chinrest base fitted with hook-and-loop fastener.
Figure 5:
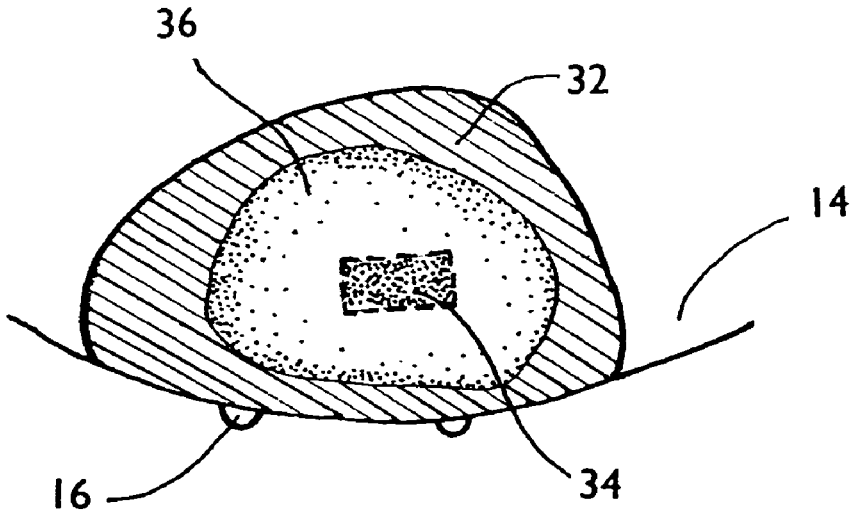
FIG. 5 illustrates a top side view of the invented chinrest base, hook-and-loop fastener, and impression taking putty in pre-impression taking position.
Figure 6:
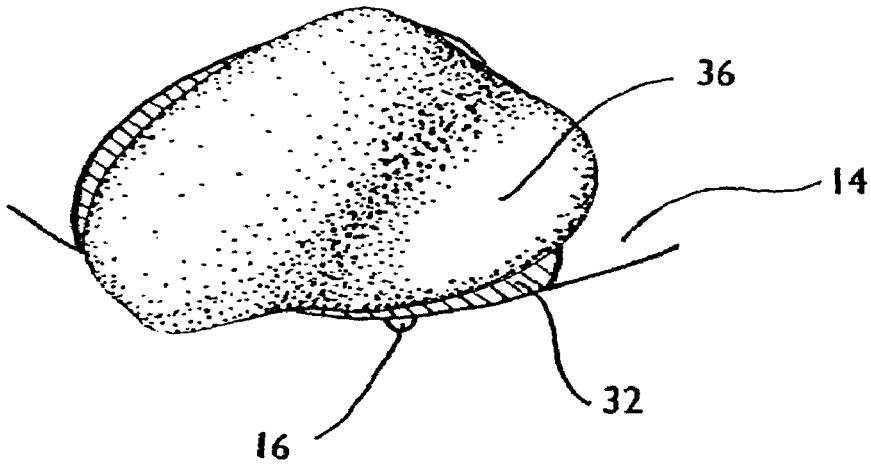
FIG. 6 illustrates a top side view of the present invention of the whole chinrest with a chin impression disposed therein.

As shown in FIGS. 3-3A, the invented base is especially designed to eliminate a preexisting support edge 20 on the player's side, and also to provide a flat top surface 32 that is entirely otherwise flat and thus uncommitted to any contour not created entirely by the performer when applying the impression taking putty top 36. In the preferred embodiment, the invented base FIGS. 3-3A is comprised of a room temperature curing polyurethane resin exhibiting a shore A hardness of 72, such as Smooth Cast 325 Liquid Plastic Resin (Smooth-On Inc., Easton, Pa.). The invented base FIGS. 3-3A is provided with a clamp 16 which will attach the invented base FIGS. 3-3A to the violin or viola FIG. 1. The invented base FIGS. 3-3A is also provided with a strip of hook-and-loop fastener 34 which will attach the invented base to the hardened impression taking putty top 36 after the impression has been taken and the mold has cured. In the preferred embodiment, this strip of hook-and-loop fastener 34 is attached to the invented base and its partner strip of hook-and-loop fastener is attached to the impression taking putty top 36. In the preferred embodiment, this strip of hook-and-loop fastener 34 is attached to the invented base and to the impression taking putty top 36 using a room temperature vulcanizing silicone adhesive such as Dow Corning 732 Silicone Adhesive (Dow Corning Chemical Company, Midland, Mich.). It is preferable to use an attachment means that will allow the impression taking putty top 36 to be reversibly removed from the invented base if, for example, it is necessary to reform the shape of the impression taking putty top 36, if the proper shape is not initially obtained, or to replace the impression taking putty top 36 with one shaped for a different performer if the instrument is used by two players, as is often the case in a school orchestra, or if the instrument is sold or traded. However, the attachment means should be sufficiently secure so that extended hours of playing the violin or viola with typical amounts of pressure applied to the chinrest will not cause the impression taking putty top 36 to dislodge from the invented base. As an alternative attachment means, it is anticipated that any type of adhesive materials such as glue, paste, magnets, plastic or epoxy resin, and the like and any mechanical attachment means such as screws, brackets ties or any combination of any of the forgoing may be used without departing from the scope of the present invention.

As shown in FIG. 7, the preferred embodiment, the impression taking putty top 36 of the chinrest is comprised of a volume of platinum catalyst, two part, room temperature vulcanizing, silicone rubber putty such as Equinox (Smooth-On Inc., Easton, Pa.). First, the player attaches the invented base to the edge of the violin or viola using a traditional clamp 16 for this purpose, or any other secure attachment means. Next, the player kneads the two parts of the volume of silicone putty together in order to activate the cure. As the putty begins to cure, the player squeezes it into a thick enough shape which will allow an impression to be made therein, then places that volume of silicone putty onto the center of the invented base. Next, the player will place the violin into playing position on her shoulder, after which she will find the center of her chin and jaw hold upon the invented base, and by using her chin and jaw will depress the putty in order to record the center of her impression range. She will then roll her head backward leaving her chin or jaw in contact with the chinrest to create the forward arc of motion, the one eliminating all edge at the jaw entry point of the chinrest. Next, she will rock her head to the left side to create a wider impression area 40 into which her jaw will finally sit and possibly shift in the final chinrest. Finally, she will take any other jaw depressions necessary to describe the arc of rotation of the head she wishes to employ while playing. These impression taking steps do not need to be performed in the order stated. All of the desired impressions must be recorded into the impression taking putty top before it has time to cure. When the silicone putty has cured, the impression taking putty top 36 is completed and is ready to attach to the invented base, using the strip of hook-and-loop fastener 34.

It is preferable that the invented base be produced in a number of sizes to accommodate all ages of players, and also in a number of styles to accommodate preferred placement of players' heads in the general location on the violin preferred by the each player. For example, some players prefer to hold the instrument over the tailpiece 12, and thus the tailpiece 12 will need a sufficient protection from the pressure of the head, while other players place their head to the left of the tail piece 12, and still other players prefer a placement to the right of the tailpiece 12. It is also preferable that a large enough volume of silicone putty will be provided to allow the player sufficient impression taking putty top 36 material in order to make a high or low chinrest based upon the amount of silicone putty used for this purpose. It is likewise important that the player take impressions of a range of motion in addition to the initial center impression, because violinists shift and move their position while playing, and unless the impression mold describes this arc, an accurate impression that will fit the playing needs of the performer will not be taken. Although the silicone putty can be cured at room temperature, its cure can be accelerated by using the heat from a hairdryer.

Once the silicone rubber putty has vulcanized, the chinrest will be complete except for the final adhesion of the impression taking putty top 36 to the invented base. It is recommended that the player practice her violin using this unadhered impression taking putty top 36 for a trial period, in order to assess the accuracy of the impression and comfort of the chinrest, before adhering the impression taking putty top 36 to the base. Once the accuracy of the impression taking putty top 36 has been confirmed, in the preferred embodiment, the player may then adhere the strip of hook-and-loop fastener 34 to the impression taking putty top 36. This strip of hook-and-loop fastener 34 is preferable for fine adjustment purposes; if the performer has not captured the rotation of her head exactly, it will be possible for her to remove the chinrest and rotate it slightly to the right or the left. Alternatively, this strip of hook-and-loop fastener 34 may be eliminated, and the player can choose to adhere the impression taking putty top 36 to the invented base using silicone rubber adhesive, or by using a primer, and allowing the silicone putty to create its own adhesion to the invented base through curing. As a further option, it will be possible for the player to choose a durometer of silicone rubber putty that will be most supportive and comfortable for his playing needs. If a surface customization is desired, the preferred embodiment material is an RTV silicone of a softer durometer such as one that is close to the durometer of skin like a shore A hardness of 003, such as is found in Ecoflex (Smooth-On Inc, Easton, Pa.). Also, the player will have the option of coating the silicone rubber portion of her chinrest by removing it from the base and coating it with either a softer or harder rubbery material. In this way, the player can customize the texture of the surface layer via softness, shine and color. In performing this step, the impression taking putty top 36 will be removed from the invented base and set on a worktable. This shore A hardness 003 silicone can be dispensed in a double barrel mixing tube in a part a and b preparation, and then spread or painted onto the finished chinrest top component. It is then allowed to cure. This finish can be prepared in several durometers, and can be dyed in several colors in order to further customize the look and feel of the finished chinrest.

The final chinrest top component can be reattached to the base and the chinrest will be complete. If a fine tune adjustment of angle is desired, the player can accomplish this by disengaging the hook-and-loop fastened impression taking putty top 36 component and repositioning it on the invented base. If another impression taking putty top 36 is desired of a different color or durometer, the existing impression taking putty top 36 can be removed, and a new top can be made of a different durometer. If a mistake is made in the mold making process, it is simple to remove the ill fitting impression taking putty top 36 and begin again using the same invented base component. If an error is made in the initial mold and the player is aware of it before the putty has cured, the player will have time to remove and re-knead the putty replace it on the invented base in the aforementioned way, and take a new set of impressions without wasting the initial putty. If a player's final chinrest is of a size and or shape that will not allow it to fit into their standard case while attached to the violin, it will be simple for the player to remove it and store it in another compartment inside the case. The resulting chinrest FIG. 7 fits the exact shape and contour of a players chin and jaw in the precise range of motion that the player requires, with a customizable durometer to meet a wide variety of player preferences.

CONCLUSION, RAMIFICATIONS, AND SCOPE OF INVENTION

Thus the reader will see that the chinrest of the invention provides a complete device and fabrication system which enables a violinist or violist to create her own custom molded chinrest in a short period of time. The completed chinrest provides a unique, firm but flexible support, and is molded to the precise contours of the player's chin and jaw improving the comfort and endurance of the player. Finally, the chinrest will allow a player to record her own range of motion into the custom mold, and thereby increase her comfort, support and flexibility within a precision violin hold while in the act of playing.

Furthermore, the custom molded chinrest of the invention has additional advantages in that:

the impression taking top is molded out of room temperature vulcanizing silicone, one of the most inert substances that can be used for mold making, and therefore one of the safest next to human skin;

the impression taking top can be molded in varying durometers in order to meet precise individual preferences of comfort and support;

the player can make interchangeable impression taking tops in different colors, durometers, or for different players, while still using the same rigid base, without having to remove the rigid base from the instrument; and the custom molded chinrest will alleviate muscle strain, and reduce chafing, neck calluses, and other skin conditions resulting from an ill-fitting chinrest.

While my above description contains many specificities, these should not be construed as limitations on the scope of the invention, but rather as an exemplification of one preferred embodiment thereof. Many other variations are possible. For example:

The custom molded top of the chinrest could be comprised of another malleable material. The rigid base of the chinrest could be comprised of another rigid material. The chinrest could be molded without a rigid base, and instead, use an interface and the surface of the violin, or simply, the surface of the violin alone, as an impression taking base, and in this case, a different clamping method could be used, such as rubber bands and eyelets, for example. Accordingly, the scope of the invention should be determined by the appended claims and their legal equivalents, not by the examples given.

I claim:

1. An assembly for making a chinrest for a violin or viola, comprising:

(a) a volume of malleable material for creating a custom molded support structure from an individual player's chin and jaw indentations into the material, said malleable material being cured after said molded support structure is made therein;

(b) a rigid base having a surface for receiving the malleable material, wherein the surface faces the instrument player's chin or jaw contact points and the surface further comprises a center and an outer periphery, the center and the outer periphery and the intervening points having a common elevation resembling a flat platter;

(c) attachment means for attaching said base to said violin or viola; and (d) when completed the malleable material hardens to provide a resilient interface according to the player's chin or jaw impressions attached to the base surface, wherein the periphery of the base facing the user is covered in a protective layer of the material, so that the rigid surface of the base cannot interfere with the player's chin, jaw, and neck to cause injury or discomfort.

2. The assembly of claim 1, wherein said volume of malleable material comprises a kneadable putty which is soft enough to depress with a chin or jaw and cures at room temperature when said custom molded support structure has been recorded therein.

3. The assembly of claim 2 wherein said kneadable putty is comprised of silicone putty.

4. The assembly of claim 2 wherein said volume of malleable material is approximately the size of said base when depressed and spread by the chin and jaw.

5. The assembly of claim 1, and further comprising a strip of hook-and-loop fastener for attaching the malleable material to the base surface.

6. A method of making a complete violin or viola chinrest that conforms the unique contours and range of motion of a player's chin and jaw comprising the steps of:

a) providing a volume of malleable material which cures at room temperature, b) providing a chinrest base that is flat and smooth with rounded edges, providing an attachment means for attaching said malleable material to said chinrest base, c) attaching said chinrest base to said violin or viola, d) positioning said malleable material on said chinrest base, e) positioning said violin or viola in a playing position with said player's chin and jaw disposed on said malleable material, f) lifting and replacing said player's chin and jaw into said malleable material in order to record the multiple chin and jaw positions favored by said player, thus creating a series of imprints which together describe the complete range of motion of a player while in playing position, g) allowing said malleable material to cure at room temperature in order to retain said imprints therein; and h) securing said hardened malleable material to said attachment means, i) securing said chinrest base to said companion attachment means, j) securing said hardened malleable material to said chinrest base using said attachment means, k) marrying the attachment means on said malleable material to the companion attachment means on said chinrest base thus enabling said chinrest to be reversibly removed and then attached at will.

7. The method of claim 6 wherein said attachment means comprises a hook-and-loop fastener.

8. The method of claim 6 wherein said volume of malleable material comprises silicone.

9. The method of claim 6 wherein said chinrest base comprises a polyurethane resin.

10. The method of claim 6 wherein said chinrest base is entirely flat.

11. The method of claim 6 wherein the side facing the player of said chinrest base is rounded to meet the top flat surface without exhibiting a sharp edge.

12. The method of claim 6 wherein said malleable material is approximately the size of a violin or viola chinrest.

13. A method of making a complete violin or viola chinrest that conforms to the unique contours and range of motion of a player's chin and jaw, comprising the steps of:

a) providing a volume of malleable material which cures at room temperature;

b) providing a base having a surface for receiving the malleable material, the surface having a center and an outer periphery with a common elevation resembling a flat platter;

c) attaching said chinrest base to said violin or viola so that the surface of the base faces the player's chin or jaw contact points;

d) positioning said malleable material on said chinrest base;

e) positioning said violin or viola in a playing position with the player's chin and jaw disposed on said malleable material;

f) lifting and replacing the player's chin and jaw into said malleable material in order to record the multiple chin and jaw positions favored by the player during play, thus creating a series of imprints which together describe a complete range of motion of the player while in playing position; and g) allowing said malleable material to cure at room temperature in order to retain said imprints therein.

* * * * *